US006247181B1

(12) United States Patent
Hirsch et al.

(10) Patent No.: US 6,247,181 B1
(45) Date of Patent: Jun. 19, 2001

(54) BANDANA HEAD-PROTECTOR USING FABRIC AND CLOSED-CELL FOAM

(76) Inventors: Karen J. Hirsch; Timothy J. Hirsch, both of 1744 Coolidge Ct., Eau Claire, WI (US) 54701

( * ) Notice: Subject to any disclaimer, the term of this patent is extended or adjusted under 35 U.S.C. 154(b) by 0 days.

(21) Appl. No.: 09/345,927

(22) Filed: Jul. 1, 1999

(51) Int. Cl.[7] ..... A41D 23/00; A41D 13/00
(52) U.S. Cl. ..... 2/207; 2/412; 2/425; 2/171
(58) Field of Search ..... 2/410, 425, 206, 2/171, DIG. 11, 207, 181, 411, 412, 414, 417, 418, 172, 183, 204, 181.2

(56) References Cited

U.S. PATENT DOCUMENTS 2,519,512 * 8/1950 Stone ..... 2/207
3,618,140 * 11/1971 Goldfarb ..... 2/207
4,521,922 * 6/1985 Mitchell et al. ..... 2/171
4,698,852 * 10/1987 Romero ..... 2/171
5,058,211 * 10/1991 Hanks ..... 2/206
5,161,260 * 11/1992 Reynolds ..... 2/207
5,542,127 * 8/1996 Bezanis ..... 2/207
5,594,956 * 1/1997 Barrientos ..... 2/207
5,685,016 * 11/1997 Douglas ..... 2/171
5,930,841 * 8/1999 Lampe et al. ..... 2/425
5,946,734 * 9/1999 Vogan ..... 2/412
5,963,989 * 10/1999 Robertson ..... 2/425
6,000,062 * 12/1999 Trakh ..... 2/425

* cited by examiner

*Primary Examiner*—Amy B. Vanatta

(57) ABSTRACT

This invention provides a device designed to reduce head injuries among soccer players, and others who would not otherwise wear head protection. It integrates closed-cell foam padding into a traditional bandana form. Foam padding is sewn between layers of fabric in positions which will provide a degree of protection from rotational forces and from direct blows to the forehead, sides, and top of the head.

3 Claims, 7 Drawing Sheets

BANDANA HEAD-PROTECTOR USING FABRIC AND CLOSED-CELL FOAM

CROSS-REFERENCE TO RELATED APPLICATIONS

Amended in response to Office Action

Application Number 09/345,927

Examiner: Amy B. Vanatta

Group Art Unit: 3741

STATEMENT REGARDING FEDERALLY SPONSORED RESEARCH OR DEVELOPMENT

Does Not apply

REFERENCE TO MICROFICHE APPENDIX

Does not apply

BACKGROUND OF THE INVENTION

This invention provides a device designed to reduce head injuries caused by direct impact and by rotational forces among soccer players and others who would not otherwise wear head protection. It integrates a unique configuration of two-ply closed-cell foam padding into a traditional bandana form.

Soccer remains one of the few contact/collision sports for which the players do not regularly use protective headgear. Since 1991, however, medical researchers have documented evidence of brain damage from repeated heading of the ball, and of frequent concussions from head to head collisions. The device described in this application provides a unique solution to the need for soccer head protection. It uses a traditional bandana form of flexible cloth. Then a foam padding is integrated into it for protection of the forehead, sides, and top of the head.

Soccer players receive head injuries from collisions with other players, from collision with goal posts, and from heading the soccer ball. The headgear described in this patent application is designed to reduce the hazards of all three. It is uniquely designed, however, to reduce the hazards of heading the ball. Injuries to the head from heading the ball are caused by the shock of direct impact, and also by rotational forces—the way the head can be jerked around by contact if the blow is not exactly direct, especially if the surface of the head (or a device on the head) grips the ball on contact. Rotational forces are likely the most important contributor to the cumulative damage to the brain caused by heading the ball.

The device described in this patent application incorporates two unique features which reduce the tendency of the ball to rotate the head when it hits it. First, this headgear has a unique two-ply design of synthetic foam, the outer layer of which is sufficiently dense so that it immediately deflects the ball rather than allowing it to grip the head in any way. The outer, more dense, ply also distributes the impact of the strike over a larger area and transmits it to the inner, less dense and more shock-absorbent layer. Secondly, the two-ply foam is configured in the headgear in way specifically designed to allow the ball to deflect easily when the header is not a precisely direct hit. Both features of this device reduce the likelihood of sudden rotation to the head of the wearer.

Soccer league rules currently prohibit the wearing of any hard-shelled or rigid objects. Soccer officials are rightly concerned that such objects worn by one player may cause an injury to another. Thus head protection for soccer players must be made of shock absorbing materials with a soft shell and no rigid components. The device described in this patent uses no hard shell or rigid components.

In order to function, head protection for soccer players not only must adhere to the rules of the game, it must also be acceptable to the players, coaches, and league officials. The device described in this patent is designed to interfere as little as possible with the simple, open-air traditions of soccer. It is also designed to permit players to play exactly as they would play without the device. The bandana form is comfortable to wear, requires no chin strap, stays on the head during action in the game, and requires minimal care—all features essential to acceptance by soccer players, coaches and officials.

In 1987, Romero (U.S. Pat. No. 4,502,156) designed a headband to provide a degree of protection. Others (Lindgren, U.S. Pat. No. 4,910,804; Ashinoff, U.S. Pat. No. 4,947,488) have further developed the headband concept. These headband devices provide protection to the forehead and sides of the head, but they do not include padding for the top of the head. Soccer players are taught to "head" the ball with their foreheads, but in actual game conditions, that is often not what happens. Systematic observations of both professional and amateur players, show that the point of contact between the soccer ball and the player's head is the forehead region less than sixty percent of the time. The device described in this application uniquely provides protection to the forehead, the sides, and the top of the head.

The device patented by Lampe et al (U.S. Pat. No. 5,930,841) does disclose padding for the top, sides, and top of the head. Their device is designed on the model of a traditional helmet. They disclose a chin-strap option and other features which do not take into account the fact that the most serious hazard of heading a soccer ball comes from rotational forces. A chin strap, for example, reduces the likelihood of the device from falling off during play, but it also does not allow the kind of slippage between the device and the head which reduces rotational forces. Further, they describe the device as possibly having "a tacky outer surface, having . . . a coefficient of friction greater than that of wet or moist hair or skin. Such an outer surface is particularly suited for soccer as it slows the rotation of the soccer ball when struck by the head of a player and allows more control over the direction of the ball." What they describe is exactly the opposite of what one needs in a device designed to reduce injuries caused by rotational forces. In this iteration, the Lampe et al device would cause more damage than a bare head.

The device in this application discloses no chin strap specifically because a strap adds to the hazards. In includes a laminated two-ply design and a configuration for the placement of the padding in the device which will reduce the transfer of rotational forces to the player's head.

The bandana form has been used for centuries as a device to cover the head and protect it from the elements, dirt, and insects. Barrientos and Heriberto, in their 1997 patent (U. S. Pat. No. 5,594,956) itemize the great flexibility and utility of the bandana form. However, our patent application goes beyond theirs by devising a system for incorporating foam padding into the traditional bandana form. The device described in this patent provides a degree of protection from blows to the head which theirs does not.

A device patented by Hanks (U.S. Pat. No. 5,058,211) is one example of the versatility of the bandana format. His device, like the one described in this application, discloses a bandana form with padding sewn in. His patent, however, clearly shows that the application he has in mind was protection of the face and neck. His device discloses a rectangular configuration of padding which does not effectively reduce the risk of heading a soccer ball. Further, his specifications for the padding itself will not work in soccer headgear. In fact, if used for soccer headgear, both the disclosed padding and the configuration for the placement of the padding, would likely increase the potential for rotational head injuries.

Hanks further discloses a design of "tying ears" as the means of fastening the device around the wearer's neck. Such a system will not work for soccer because the hard mass created by tying the ears creates an unacceptable hazard for soccer players who might fall on the backs of their heads.

Goldfarg (U.S. Pat. No. 3,618,140) also discloses a "scarf hat" which shares some features with the device described in this patent application as well as with Hanks (U.S. Pat. No. 5,058,211). She, too, discloses padding sewn into a piece of folded cloth. Again, however, because she designed her device as a piece of clothing rather than as protection in sports activities, the design she discloses for the padding as well as the configuration in the hat, will not work for soccer. In the "Background" for her device, she discloses that "the pliable filler material maintains the shape of the hat structure."Because the padding in her device is there to help the hat keep its shape, her patent does not disclose either a description for a padding design or padding's configuration in the hat which would enable someone to make protective headgear for soccer.

Although designed primarily for use by soccer players, the [device designed in this application] will also function to provide a degree of protection in any situation where the wearer does not need or want the full protection of a hard-shell helmet. It is light (1.5 ounces), washable, attractive to wear, compact to store, and it resembles an ordinary bandana. All these features will allow it to be utilized for head protection when a helmet would not be acceptable.

BRIEF SUMMARY OF THE INVENTION

The bandana head-protector combines a traditional bandana form [and new foam technologies] with a unique design of laminated foam, sewn into the bandana in a unique configuration, to create a degree of head protection for soccer players and others who would otherwise not wear any.

The bandana head-protector consists of a bandana sized piece of cloth (approximately 21"×21"). Shock absorbent foam inserts are strategically placed on the cloth. The cloth is folded diagonally over the inserts to form a triangular shape. The inserts are sewn in place between the two folds of cloth. At two corners, the double folds of cloth are folded inward approximately two inches and sewn in place. Hook and loop fasteners are sewn on to these two corners, and to the "tail" of the bandana. The hook and loop fasteners are drawn together to form an adjustable spherical from which fits on a wearer's head. The tail of the bandana is pulled over the top of the wearer's head and fastened to form, with the other two cornters, a three-point anchor. Other fastener types may also be used as long as they do not include hard surfaces or create a knot or other solid mass.

The bandana head-protector provides protection from rotational and direct impact forces to the forehead, sides, and top of the head—a greater range of protection than provided by headband style devices and helmet-style devices.

In repeated field trials, the device stayed on the heads of soccer players in every game situation. It did not interfere with the flow of the game in any way. It is easy to customize the color and print of the fabric without altering its protective components of the device.

This device protects the head in situations when no head-protection would otherwise be worn, and in a way not available in any other device. It is washable, compact, lightweight, attractive in appearance, inexpensive to manufacture, and appropriate to the official rules and unofficial traditions of soccer.

BRIEF DESCRIPTION OF THE THE DRAWINGS

The drawings described here provide an overview of the head protector, and step by step illustrations of compostion of the device and how it is put together. The first figure provides an overview, and then the other six figures provide more detail.

Figure 1:
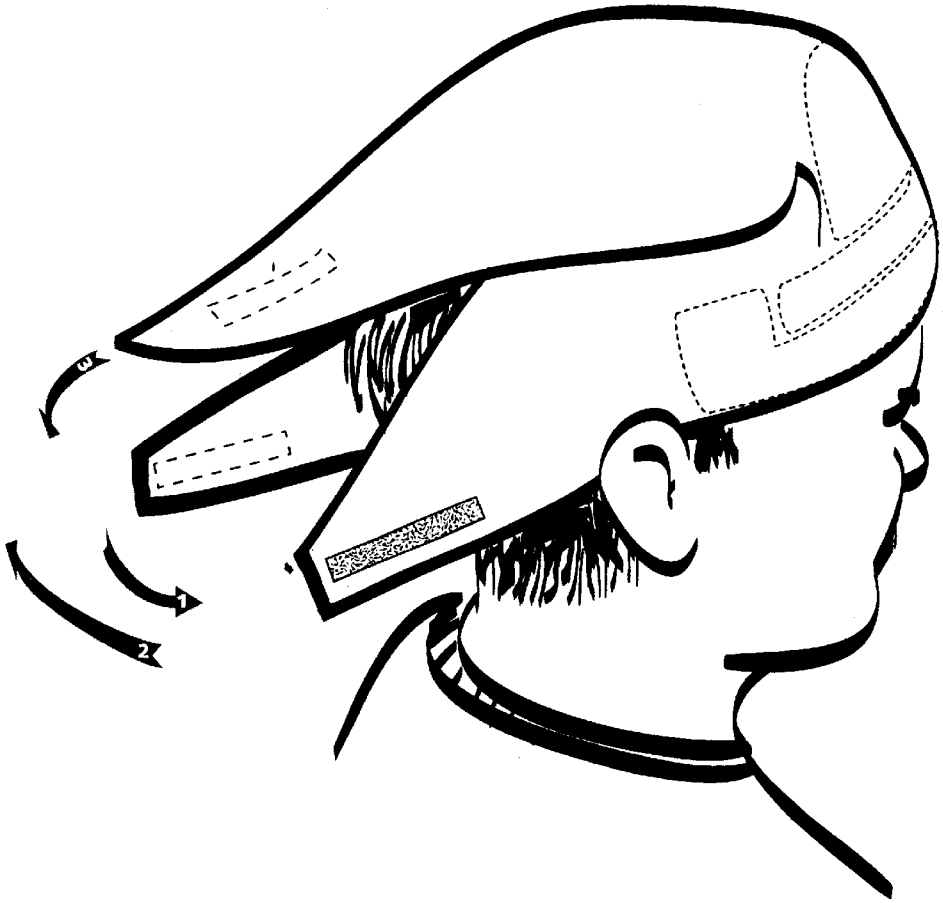
FIG. 1 is a three dimensional view of the head protector revealing how it fastens to fit on the head of a wearer.
Figure 2:
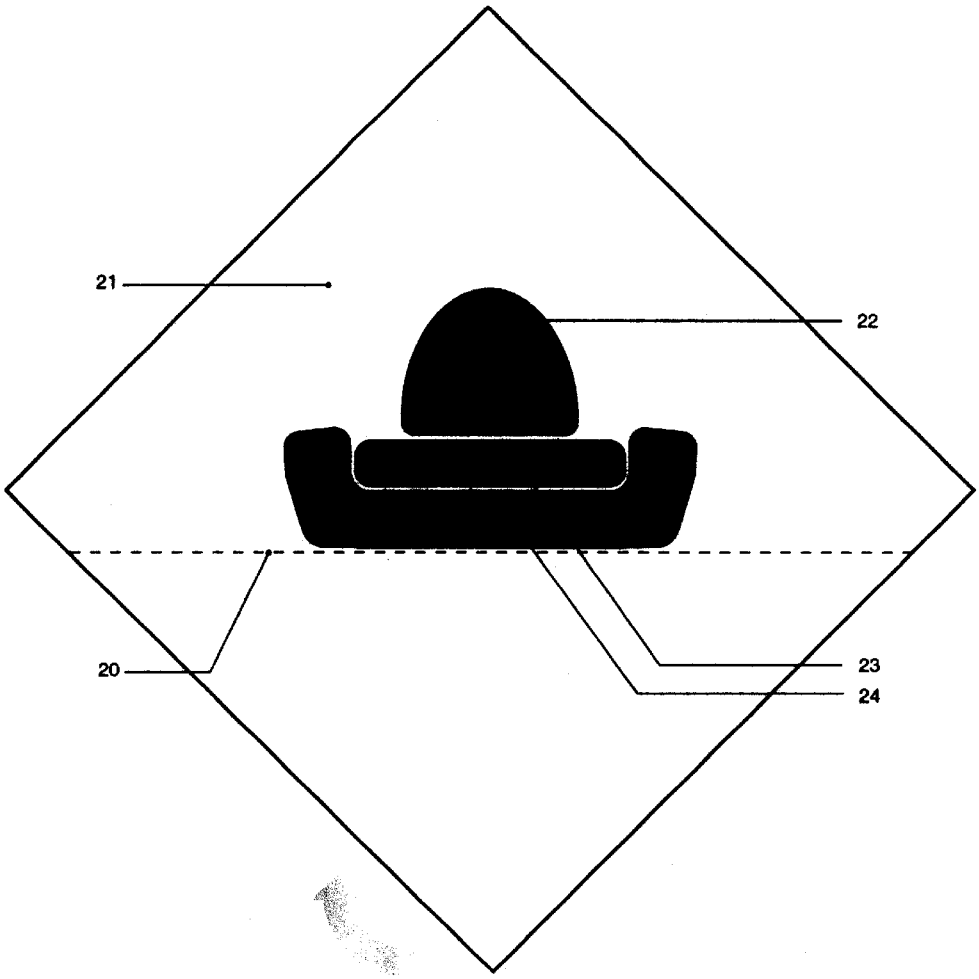
FIG. 2 illustrates the initial bandana form, the placement of the foam inserts, and the line and direction of the first fold.
Figure 3:
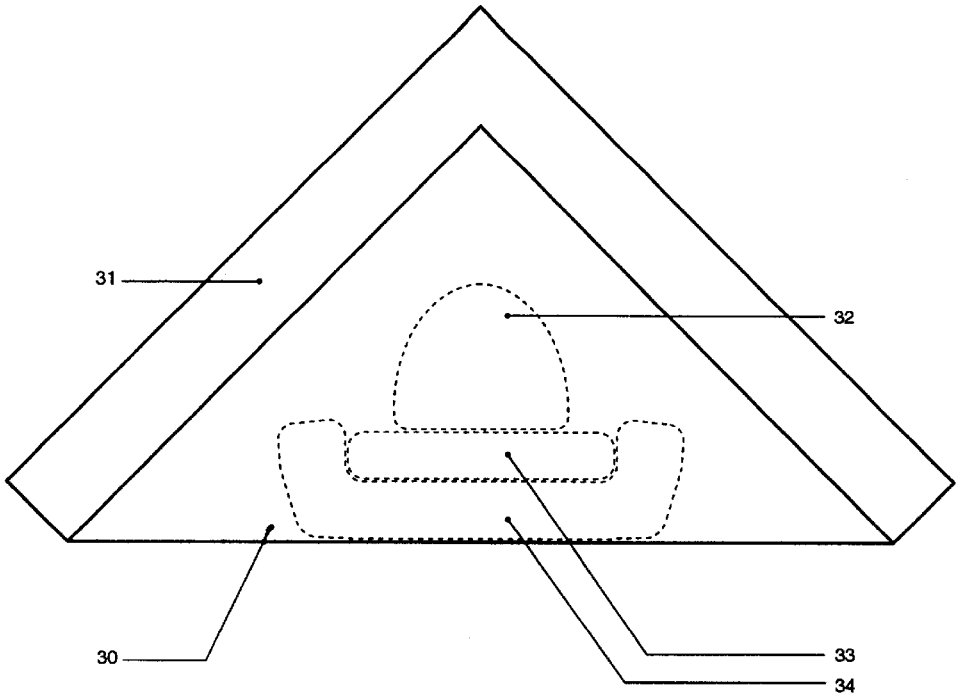
Figure 4:
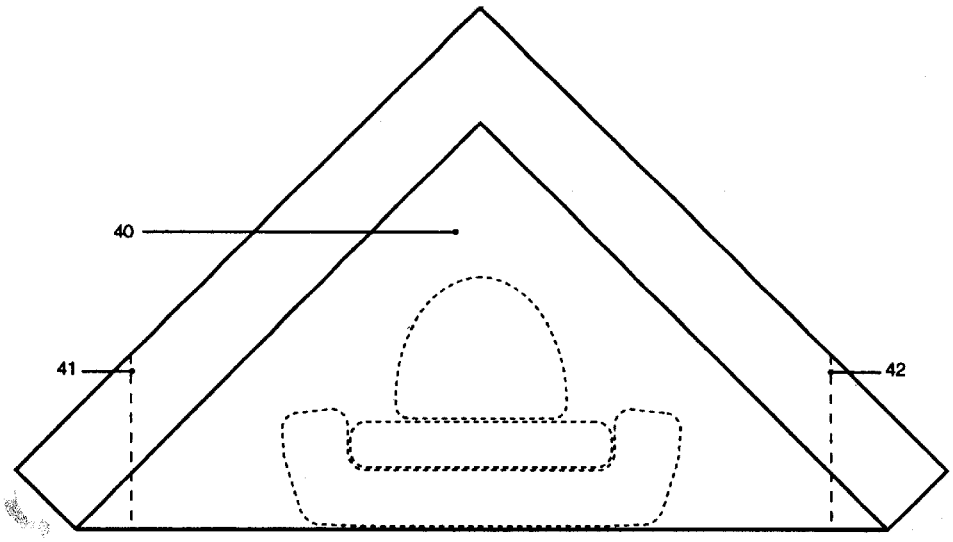
Figure 5:
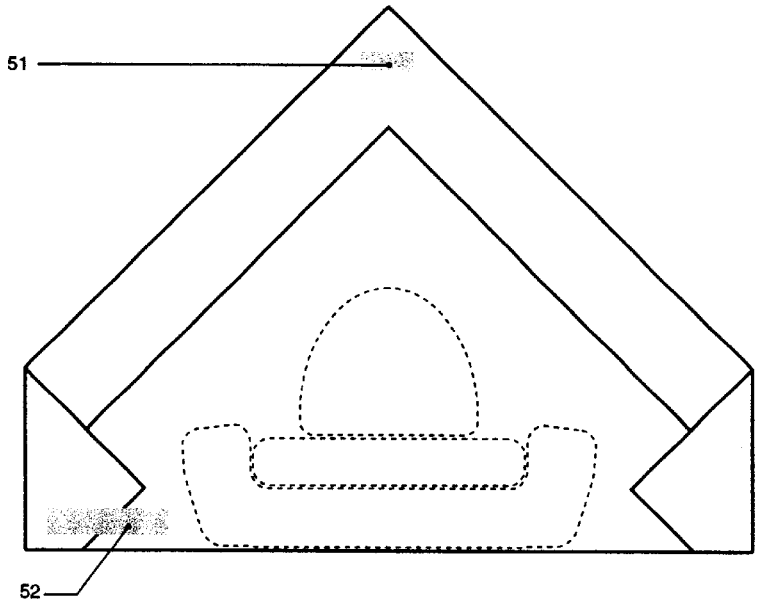

FIG. 3 provides a view of the form which results after the first fold, including the foam inserts positioned with cloth both underneath and on top, ready for sewing in place;

FIG. 4 illustrates the line and the direction of two more folds made to form anchoring places for hook and loop fasteners;

FIG. 5 shows where the hook fasteners are sewn on

Figure 6:
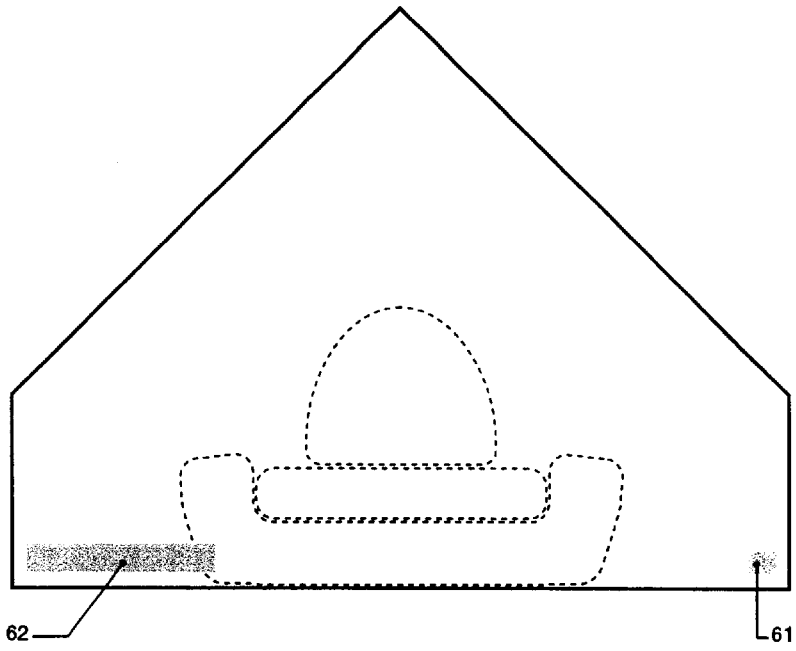
Figure 7:
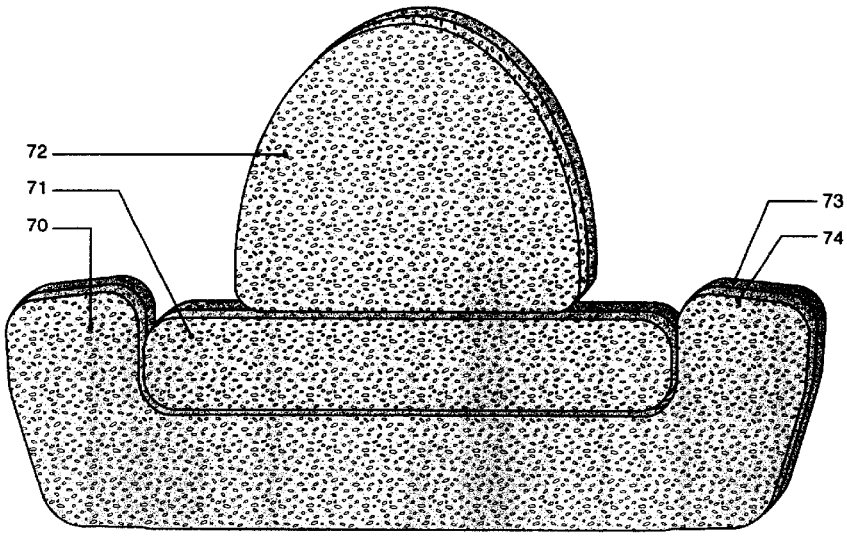

FIG. 6 shows the reverse side of the head protector and the placement of the two loop fasteners;

FIG. 7 provides an orthographic illustration for the lamination and configuration of the foam inserts.

DESCRIPTION OF THE INVENTION AND THE SEVERAL VIEWS OF THE DRAWINGS

The bandana head-protector described in this application uses the following materials: a piece of square cloth of about 20–22 inches in length and width, foam inserts either molded, die-cut or cut with any other other suitable technique, and hook and loop fasteners or other suitable fasteners. Hook and loop fasteners are the preferred embodiment.

The cloth fabric may be of any pattern, print, or color. It may be of cotton, nylon, Dacron, silk, or any other similar material. The cloth should be hemmed on four edges. Light cotton is an example of a preferred fabric, especially one in colors and/or patterns appropriate for a specific soccer team.

The foam inserts may be cut in a variety of shapes appropriate to fit the top, sides, and forehead of the person wearing the device. They may vary in thickness from about ½ inch to a full inch. The inserts may vary in density from 2.0 pounds per cubic foot to 9.0 pounds per cubic foot. FIG. 6 represents the preferred format, both in the shape, composition, and disposition of the inserts. The preferred inserts represented in FIG. 7 are formed from two plies of closed-cell foam, one 9.0 pound per cubic inch in density, 3/16" thick, and the other 2.0 pounds per cubic foot, also 3/16 inches thick. In the preferred embodiment, the less-dense foam will be placed nearest the head, and the more dense foam away from the head.

Turning now to details referenced by the drawings:

FIG. 1

This drawing represents the bandana head-protector as it would be worn on the head. The dotted lines represent the positioning of the foam padding when the bandana is in place. Note that the foam pieces bend to form curved pieces which conform to any sized head. The padding comes across the forehead, well around the sides, and over the top of the head. An anchoring point 1 on which a strip of hook fastener has been sewn is drawn against the back of the wearer's head. An opposing anchoring point on which a strip of loop fastener has been sewn is positioned on top of the hook fastener to form an ring of cloth around the wearer's head. The top of the bandana form, on the underside of which a strip of hook fastener has been sewn, is pulled over the top of the wearer's head and fastened to a strip of loop fastener to create a closely fitting head protector.

FIG. 2

This drawing shows a piece of flexible cloth 21, approximately 20" by 20", oriented on the page in diagonal postion. Foam inserts 22, 23, 24 are positioned on the cloth in a configuration designed to maximize the deflection and absorbtion of blows to the forhead, temples and crown of the wearer's head. The bottom of the cloth is folded up from the line of dashes 20, and positioned over the inserts to form a triangular "bandana" shape.

FIG. 3

This drawing shows the cloth folded into a nearly triangular shape over the foam inserts 32, 33, 34 outlined by dotted lines which also serve as stitch lines. Following the dotted lines, the foam inserts are stitched into place between the bottom 31 and top 30 folds of cloth.

FIG. 4

This drawing shows where the right and left corners of the triangle are folded toward the center on lines 41 and 42. In that position, they are [in and] sewn into place to form anchoring places for hook and loop fasteners. The arrows in this drawing show the direction of the fold. In this stage, the device has an irregular pentagon shape, with a relatively long horizontal base of about 25", a left leg of about 3.5" at a right angle to the base, an opposing left leg also about 3.5" and at a right angle to the base, and two diagnal legs each about 17" long reaching up from the left and side legs to join at the apex in a right angle.

FIG. 5

This drawing represents the inside of the bandana—the surface which will be against the head of the wearer. On the left corner, now folded in and sewn in place, a 3.5" strip of hook fastener is sewn 52, begining at the edge of the left leg, and extending inward along the edge of the base. In the apex where the two diaganol legs form a right angle, a 2" strip of hook fastener 51 is sewn.

FIG. 6

The octagon shape is now turned front to back, and thus FIG. 6 represents the top of the bandana—the surface which will be away from the head of the wearer. Beginning on the left corner a 3.5" strip of loop fastener 62 is sewn along the base. This loop fastener will recieve the hook fastener 52 shown in FIG. 5. A 2" piece of loop fastener is attached to the right corner along the base. This piece of loop fastener will receive a corresponding piece of Velcro fastened on the bandana's "tail" 51, FIG. 5. The device is now ready to shape into a head protector. The device is reversed once again, and the corner of the base with the loop strip 62 is pulled in from the right, and the corner of the base with the hook strip 52 is pulled in from the left. The hook strip is fastened on to the loop strip. The cloth with the hook strip at the apex of the device 51 is pulled down and fastened onto the loop strip 61 now at the bottom center of the headprotector. This completes the bandana form. It is placed on the wearer's head and the tightness of the fit adjusted 1, 2, 3.

FIG. 7

This drawing shows the three closed cell foam pieces 70, 71, 72 which make up the padding for this specific configuration of padding. Each of the three pieces in this example is composed of two laminated plies of closed cell foam. The outer ply 74, the one away from the head, is relatively dense so that it can act to distribute the force of any blows over a larger surface and deflect the ball before it grips and rotates the head. The inner ply 73 is of a less dense foam, designed to cushion the impact of any blow to the padded portion of the head. In this example, each of the two plies is 3/16" thick, for a total of 3/8". Other configurations in which the pieces are arranged differently and the composition and thickness of the padding altered somewhat are possible as long the two goals of shock deflection and absorption are accommodated.

We claim as our invention:

1. A head protector in the form of a bandana with a configuration of two-ply foam sewn in to provide protection from rotational forces and direct blows to the forehead, sides, and top of the head of a wearer, comprising:

a generally square piece of supple cloth folded at or near the diagonal axis to form a generally triangular shape with two acute angles, and being further folded inward from the acute angles to form a pentagon with two opposing edges, a longest base edge, and a top right-angled corner, the two opposing edges forming right angles to the base edge;

a two-ply design of closed-cell foam comprising an outer ply of relatively dense material and an inner ply of less dense foam, said two-ply foam being positioned and sewn in place between the two folded layers of the cloth;

a strip of hook fastener sewn onto the folded cloth along a left edge of the base to form an anchoring position, and a strip of loop fasteners sewn onto a right edge of the base on the reverse side to form an opposing anchoring position, making it possible to pull the opposing edges of the pentagon together and position the hook fastener over the loop fastener to form an adjustable spherical form which fits on the wearer's head;

a square of hook fastener sewn onto the cloth at the top right-angled corner, and a square of loop fastener sewn to the base to make it possible to draw the top of the head protector snugly down on the wearer's head and connect the hook fastener to the loop fastener thus forming the top of the head protector.

2. The head protector of claim 1, wherein said two-ply design of closed-cell foam comprises three two-ply foam pieces, wherein:

one piece is a u-shaped piece of two-ply closed-cell foam positioned such that up-right legs of the u-shape cover the temples of the wearer and a horizontal part of the u-shape covers the forehead; one piece is rectangular and is positioned above the horizontal part of the u-shaped piece to cover the high forehead of the wearer; and one piece is approximately square with rounded corners and is positioned to cover the crown of the wearer's head.

3. The head protector of claim 1, wherein the head protector is made of washable materials, is light weight, and can be fabricated in a variety of colors and print-patterns.

* * * * *